United States Patent [19]

Granbom et al.

[11] 4,164,893

[45] Aug. 21, 1979

[54] SEALING DEVICE AT PRESSURE FLUID CYLINDERS

[76] Inventors: Bo Granbom, 9 Frejgatan; Gunnar Lundqvist, 7 Spinnaregatan, both of Stockholm, Sweden

[21] Appl. No.: 821,722

[22] Filed: Aug. 4, 1977

[51] Int. Cl.[2] ..... F01B 29/00

[52] U.S. Cl. ..... 92/88; 92/240

[58] Field of Search ..... 92/88, 240

[56] References Cited

U.S. PATENT DOCUMENTS

| | | | |
|---|---|---|---|
| 2,200,427 | 5/1940 | Merz | 92/88 X |
| 2,373,455 | 4/1945 | Carey | 92/88 X |
| 2,650,571 | 9/1953 | Mitchell | 92/88 |
| 2,686,402 | 8/1954 | Samuel | 92/240 |
| 3,221,610 | 12/1965 | King et al. | 92/88 X |
| 3,820,446 | 6/1974 | Granbom et al. | 92/88 |

FOREIGN PATENT DOCUMENTS

| | | | |
|---|---|---|---|
| 398998 | 9/1933 | United Kingdom | 92/240 |
| 470088 | 8/1937 | United Kingdom | 92/88 |

*Primary Examiner*—Irwin C. Cohen

*Attorney, Agent, or Firm*—Wood, Herron & Evans

[57] ABSTRACT

An improved sealing structure for a pressure fluid cylinder of the type comprising a cylinder, a longitudinal slot in the cylinder, and a driver attached to a piston movable in the cylinder, the driver extending through the slot. The sealing structure includes a strip positioned to overlie the slot in the sealing relation, the strip extending into sealing contact with the inside surface of the cylinder on opposite sides of the slot. That inside surface area of the cylinder which the strip overlies in sealing relation is provided with a cross-sectional radius greater than the cross-sectional radius of that cylinder surface area not in contact with the strip. Preferably the strip is chamfered on its inside surface toward its edges so that the height of the opposed strip edges is no greater than 0.1 mm.

7 Claims, 4 Drawing Figures

FIG.1

SEALING DEVICE AT PRESSURE FLUID CYLINDERS

This invention relates to a solution of the sealing problems at pressure fluid cylinders and, more precisely, to a sealing device at pressure fluid cylinders of the type comprising a cylinder with a longitudinal slot, through which a driver extends, which is attached to a piston movable in the cylinder, which slot is closed by means of a strip, and the piston is provided with a sealing sleeve at each end.

A pressure fluid cylinder of the aforesaid type is previously known through U.S. Pat. No. 3,820,446. The problem at a pressure fluid cylinder of this type is the difficulty of obtaining sufficient or complete tightness between the cylinder and the strip as well as between the piston and the cylinder in the area of the strip.

When a plane strip is used together with a pure cylinder surface, the strip is subjected to relative rapid fatigue with resulting strip break and untightness. When, however, the strip is given a cross-sectional shape corresponding to the cylinder surface, the strip, due to the working pressure in the cylinder, to some extent is pressed into the slot, the inner edges of which act as "hinge" and thereby give rise to leakage in the gap formed between the cylinder surface and the strip edges and in the piston sleeve.

In spite of the fact that the known strip is relatively thin, there exist great problems with conventional sleeves to obtain sufficient sealing between the sleeve and the transition between the strip edge and the cylinder surface, even when the strip is given plane shape and thereby is prevented from being pressed into the slot.

These and other serious problems at conventional pressure fluid cylinders of the type referred to above have been solved satisfactorily by the present invention as it is defined in the characterizing clauses of the attached claims.

Figure 1:
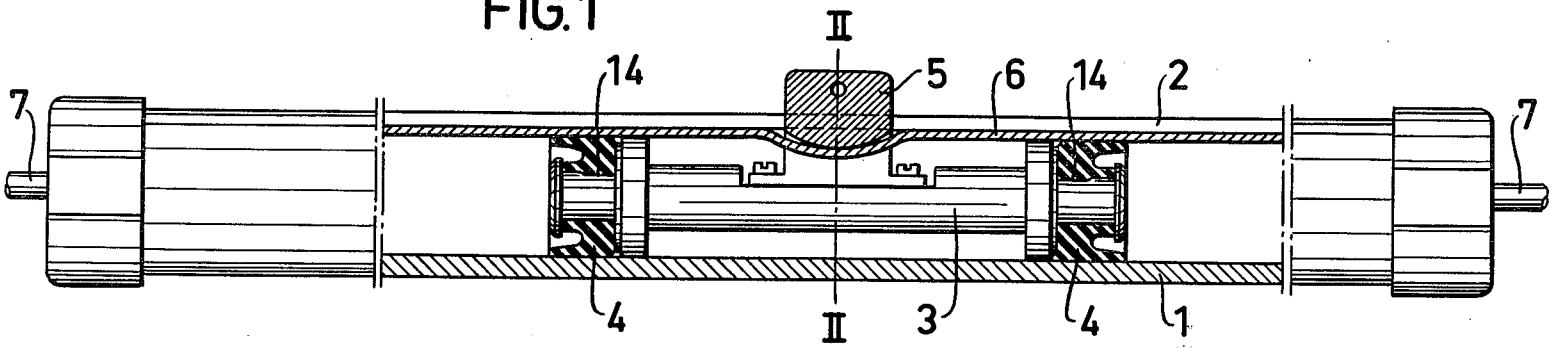
Figure 2:
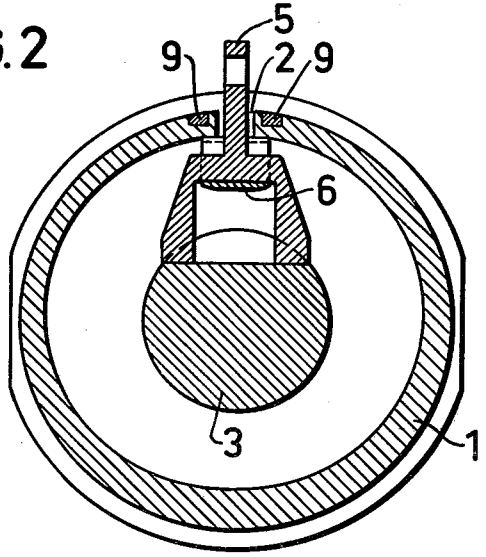
Figure 3:
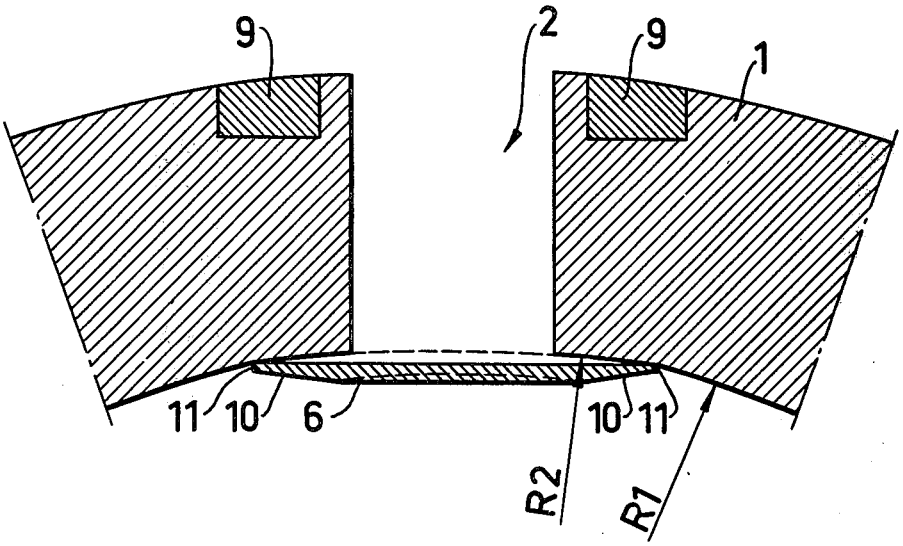
Figure 4:
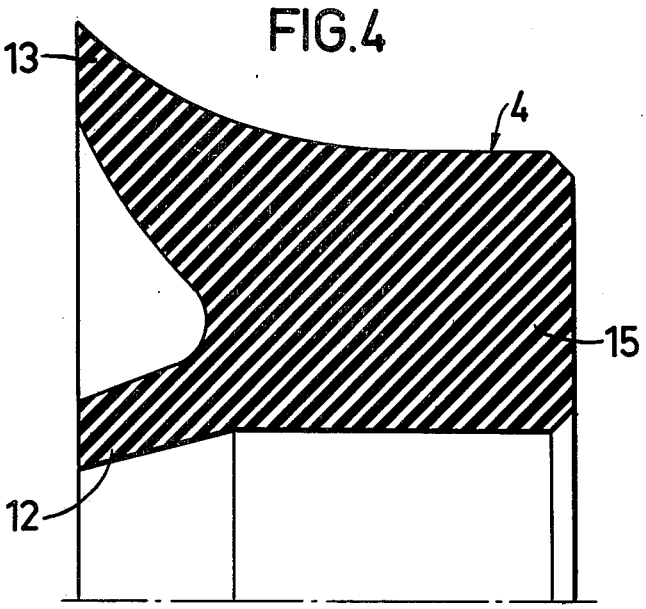

The invention is described in greater detail in the following by way of an embodiment thereof and with reference to the accompanying drawings, in which FIG. 1 schematically shows a pressure fluid cylinder according to the invention, FIG. 2 is a section through the cylinder according to FIG. 1 along the line II—II, FIG. 3 is an enlarged partial cross-section through cylinder and strip, and FIG. 4 is an enlarged partial section through the sealing sleeve according to the invention.

The pressure fluid cylinder comprises in known manner a cylinder 1, which along its entire length is provided with a slot 2. The piston 3 is provided with a sealing sleeve 4 at each end and with a driver 5, which extends through the slot 2 and can be connected to the apparatus operated by or operating the cylinder. The slot 2 in the cylinder is in known manner sealed by a strip 6 extending through the piston in such a manner, that the driver 5 can be attached on the piston. The strip 6 is held against the cylinder wall by means of magnets 9. The cylinder 1 is connected at the ends to pressure fluid supply and discharge conduits 7.

The above description covers the general structure of the pressure fluid cylinder.

The invention proper is described as follows.

The strip 6 is fully plane, but its edges are chamfered on the inside, as indicated at 10. This chamfering is carried out so that the edges 11 of the strip 6 have a height of preferably 0.05 to 0.02 mm, but not exceeding 0.1 mm.

As appears from FIG. 3, the cylinder 1 has the radius $R_1$. On each side of the slot 2, however, along a distance which, seen in a cross-section, together with the slot width at least corresponds to the width of the strip 6, the cylinder 1 is formed with a surface, the curvature radius $R_2$ of which exceeds the radius $R_1$ of the cylinder. At a cylinder radius $R_1 = 20$ mm, for example, the radius $R_2$ preferably is 230 mm, i.e. in this case about ten times greater.

The strip 6, as already mentioned, is held by the magnets 9 against the cylinder wall. When the working pressure acts in the cylinder space on one side of the piston 3, the strip 6 is pressed sealingly against the inner surface of the cylinder and thereby prevents outflow of pressure fluid through the slot 2. The strip, as indicated by dashed lines in FIG. 3, is bent against the slot 2 and abuts the cylinder surface with the greater radius $R_2$. Due to the resulting pre-stressing of the strip 6, its edges 11 remain abutting the cylinder surface in spite of full working pressure, and due to the shape of the strip and the greater radius $R_2$ the strip 6 will not be subjected to appreciable fatigue, either.

In order to render the pressure fluid cylinder capable to work under satisfactory sealing conditions, however, it is not only necessary that the strip seals the slot, but also the piston 3 must seal against the cylinder inside and against the strip 6.

For this purpose, the piston 3 is provided with a sealing sleeve 4 at each end. The sealing sleeve, as appears from FIG. 4, has substantially the shape of a lying Y. The inner leg or lip 12 abuts sealingly the piston, and the outer leg or lip 13 abuts sealingly the cylinder inside. Due to the design of the lip 13 so as to strongly expand against the inside of the cylinder, and due to the soft material of the sleeve, not exceeding 60°IHR, it is possible to ensure that the sleeve also seals at the transition between the strip 6 and the cylinder surface, the strip edge 11, and at the greater radius $R_2$ over the slot 2. The sleeve thereby can adjust well to the transition between the strip-cylinder surface and seal the slot without the air being connected.

Due to the smaller diameter of the cylinder surface and the thickness of the strip in the area of the slot 2, however, the sealing sleeve 4 in this area is subjected to a greater compression than in the remaining parts and, consequently, its wear is increased. In order to eliminate this disadvantage, the piston 3 in its portion supporting the sleeve is provided with a depression 14, which is located on the side facing toward the strip 6. The depression 14 renders it possible for the sleeve 4 with its "stem" or main portion 15 to resiliently adjust to the smaller diameter of the cylinder. The depression 14, seen by way of a cross-section, may be straight and, seen from the side, may have a shape increasing in size in the direction axially to the centre of the piston 3. The length of the depression shall at least correspond to the length of the main portion 15.

Instead of having the radius $R_2$, the surface of the cylinder cooperating with the strip may be formed of two plane surfaces, i.e. surfaces having a curvature equal to zero and forming a certain angle with each other. The plane surfaces, for example, may lie on cords to the radius $R_2$ and extend from the centre of the slot and terminate immediately outside the lines of abutment of the strip edges to the cylinder.

The characterizing features of the invention should be clearly apparent from the aforesaid. They can, of course, be modified within the scope of the attached claims with respect to the dimensions of the radii and the width and thickness of the strip, depending on different cylinder diameters.

What we claim is:

1. A pressure fluid cylinder device comprising a cylinder, a longitudinal slot in said cylinder, a sealing structure, and a driver attached to a piston movable in said cylinder, said driver extending through said slot, said sealing structure comprising a strip positioned to overlie said slot in sealing relation, said strip extending into sealing contact with the inside surface of said cylinder on opposite sides of said slot in that area of said slot through which said driver does not extend, that strip sealing inside surface area of said cylinder having a cross-sectional radius greater than the cross-sectional radius of that cylinder surface area never in contact with said strip, and said strip on the inside surface thereof being chamfered toward its edges so that the height of the opposed strip edges is no greater than 0.1 mm, and a sealing sleeve connected to said piston at each end thereof, said sealing sleeve being structured to cooperate with said strip to maintain a sealed relation therebetween.

2. A device according to claim 1, the strip edge height being of the magnitude 0.05 mm to 0.02 mm.

3. A device according to claim 1, said strip being generally planar in cross-section.

4. A device according to claim 1, each of said sealing sleeves, seen by way of a longitudinal section, having the shape substantially of a Y, its stem being in parallel with the longitudinal axis of said piston.

5. A device according to claim 1, each sealing sleeve being located on a cylindrical surface of said piston which is provided with a depression on the side facing toward said strip.

6. A device according to claim 5, the length of said depression substantially corresponding to the stem of said sealing sleeve.

7. A device according to claim 4, the outer leg of said sealing sleeve sealing against the cylinder surface being formed so as to strongly expand against the inside of the cylinder, and said sleeve consisting of a soft material.

* * * * *